US005810304A

United States Patent [19]

Lehrman

[11] Patent Number: 5,810,304

[45] Date of Patent: Sep. 22, 1998

[54] IRONING BOARD HOLDER

[76] Inventor: David Lehrman, 207 Barclay Cir., Cheltenham, Pa. 19012

[21] Appl. No.: 587,075

[22] Filed: Jan. 16, 1996

[51] Int. Cl.[6] ..... A47B 96/06

[52] U.S. Cl. ..... 248/215; 248/308

[58] Field of Search ..... 248/214, 215, 248/304, 307, 316.8, 324, 339, 340, 341; 211/70.1, 116, 118

[56] References Cited

U.S. PATENT DOCUMENTS

| | | | |
|---|---|---|---|
| 373,472 | 11/1887 | Moser | 248/214 |
| 1,661,837 | 3/1928 | Little | 248/308 |
| 2,286,539 | 6/1942 | Hagerstrom | 248/301 |
| 2,500,471 | 3/1950 | Schmiedt | 248/308 |
| 2,633,998 | 4/1953 | Derman | 211/104 |
| 2,743,023 | 4/1956 | Larson | 211/96 |
| 2,842,822 | 7/1958 | Bennett | 248/339 |
| 2,925,916 | 2/1960 | Pollock | 211/86 |
| 2,959,297 | 11/1960 | Larson | 211/90 |
| 3,536,287 | 10/1970 | Kramer | 248/215 |
| 3,782,559 | 1/1974 | Wright | 248/339 |
| 4,657,249 | 4/1987 | Offutt | 273/1.5 R |
| 4,662,629 | 5/1987 | Plovie | 248/214 |
| 4,862,611 | 9/1989 | Wright | 38/103 |
| 4,899,667 | 2/1990 | Miller et al. | 108/47 |
| 4,944,434 | 7/1990 | Hamilton | 248/214 |
| 4,949,924 | 8/1990 | Carmody | 248/215 |
| 5,472,164 | 12/1995 | Contee | 248/214 |
| 5,553,823 | 9/1996 | Protz | 248/215 |

FOREIGN PATENT DOCUMENTS

| | | | |
|---|---|---|---|
| 515889 | 5/1920 | France . | |
| 821642 | 12/1937 | France . | |
| 370129 | 4/1932 | Germany . | |
| 199814 | 9/1958 | Germany . | |
| 12044 | of 1899 | United Kingdom | 248/215 |
| 293132 | 7/1928 | United Kingdom . | |

*Primary Examiner*—Ramon O. Ramirez
*Assistant Examiner*—Gwendolyn W. Baxter
*Attorney, Agent, or Firm*—Seidel, Gonda, Lavorgna and Monaco, PC

[57] ABSTRACT

A device for suspending an ironing board comprising a at least two support brackets each having an upper segment and a lower segment pivotally attached to one another by a pivotal connection. Each upper segment includes a hook end for mounting the support bracket to the top edge of a door or similar support structure. Each lower segment has a hook end for holding a leg of the ironing board so as to suspend the ironing board in an upright storage position against the face of the door. The support brackets can be adjusted to support ironing boards having T-shaped and Y-shaped legs. The device can include a crossbrace pivotally attaching the support brackets.

18 Claims, 5 Drawing Sheets

IRONING BOARD HOLDER

FIELD OF THE INVENTION

The invention relates to a holder for an ironing board, more specifically to a planar surface mountable holder for suspending an ironing board having T- or Y- shaped legs from a door, in a storage position.

BACKGROUND OF THE INVENTION

Ironing boards are common article in many households. The standard ironing board in use today is typically a free-standing model having scissor legs which are T-shaped or Y-shaped. The legs can be folded under the table of the ironing board for compactly storing the ironing board. However, even when folded, ironing boards can take up valuable storage space due to their relatively large and bulky size.

What is needed is a removable holder which can suspend an ironing board from the back of a planar surface, such as a door. A holder is needed which can accommodate ironing boards having either T- or Y- shaped legs.

SUMMARY OF THE INVENTION

The invention relates to a device for suspending an ironing board having T- and Y- shaped legs. The device comprises a plurality of support brackets each having an upper segment and a lower segment pivotally attached to one another by a pivotal connection. Each bracket includes a first hook at one end for mounting the support bracket to a planar surface, such as a door. Each bracket also has a second hook at the other end for holding a leg of the ironing board so as to suspend the ironing board in an upright position against the planar surface.

A crossbrace can also be pivotally connected between each support bracket. The crossbrace also serves to resist the lateral forces resulting from hanging the ironing board on the support brackets.

To facilitate mounting the holder on a planar surface, such as a door, the first hook can be formed into an inverted rectangular J-shape. Also, the second hook can be formed into an angled or a curved U-shaped hook for securedly holding the tubular legs of an ironing board.

Additional features and advantages of the invention will become apparent to those skilled in the art upon consideration of the following detailed description of the preferred embodiment exemplifying the best mode of carrying out the invention as presently perceived. The detailed description particularly refers to the accompanying drawings.

DETAILED DESCRIPTION OF THE PREFERRED EMBODIMENT

Figure 1:
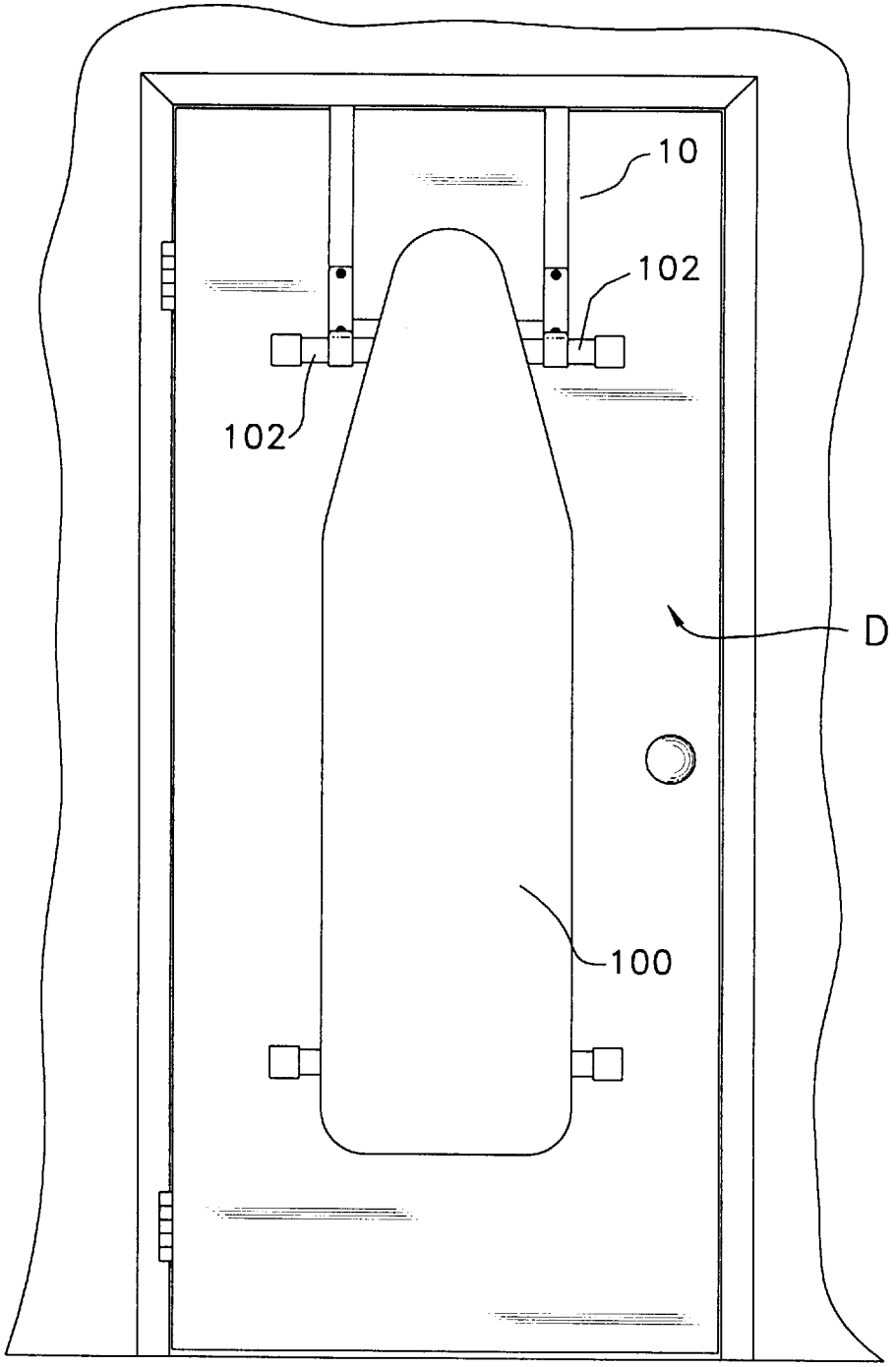
FIG. 1 is a front elevational view of an embodiment of the ironing board holder of the present invention shown hanging on a door and supporting an ironing board.
Figure 2:
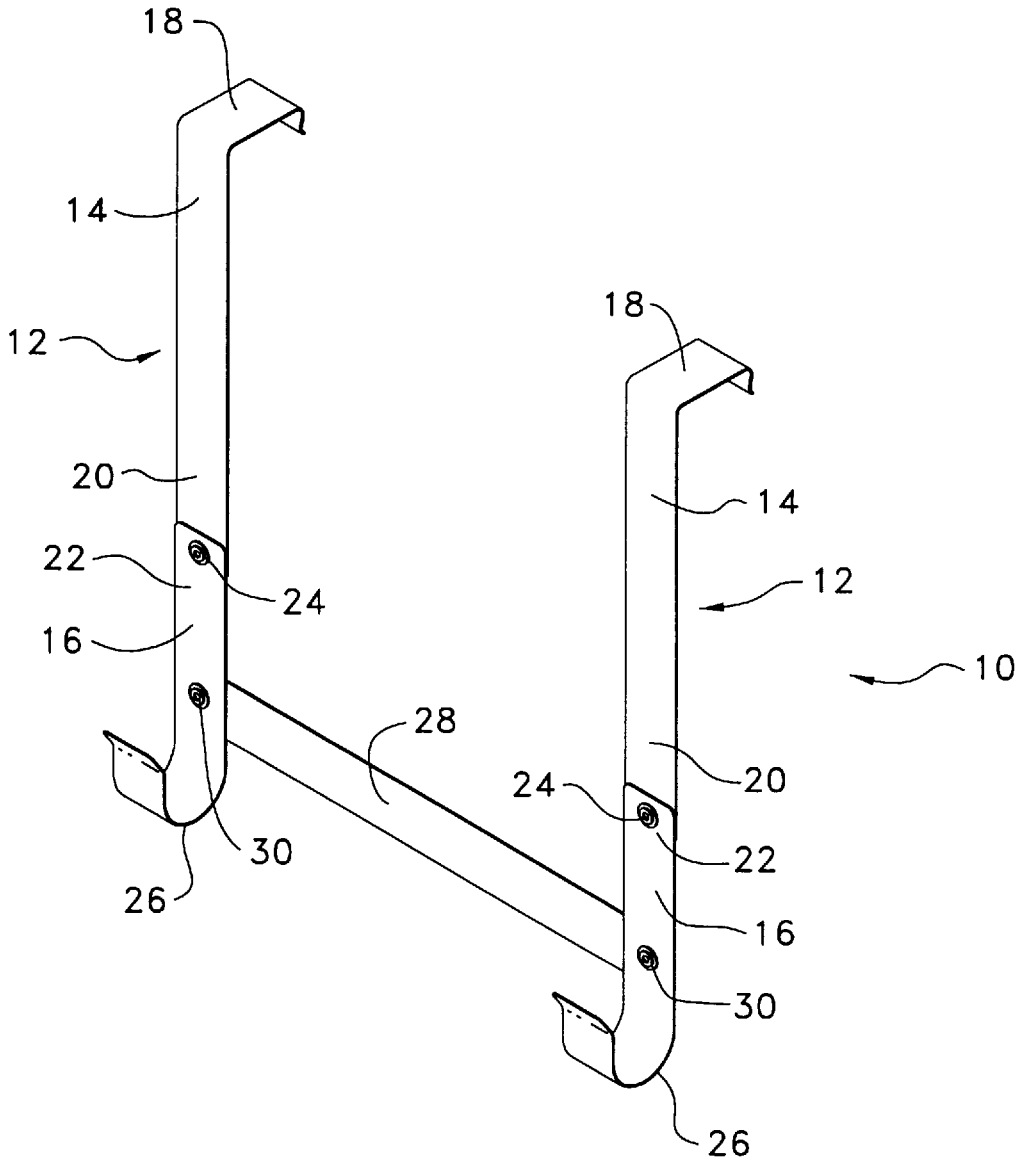
FIG. 2 is an oblique elevational perspective view of the ironing board holder.
Figure 3:
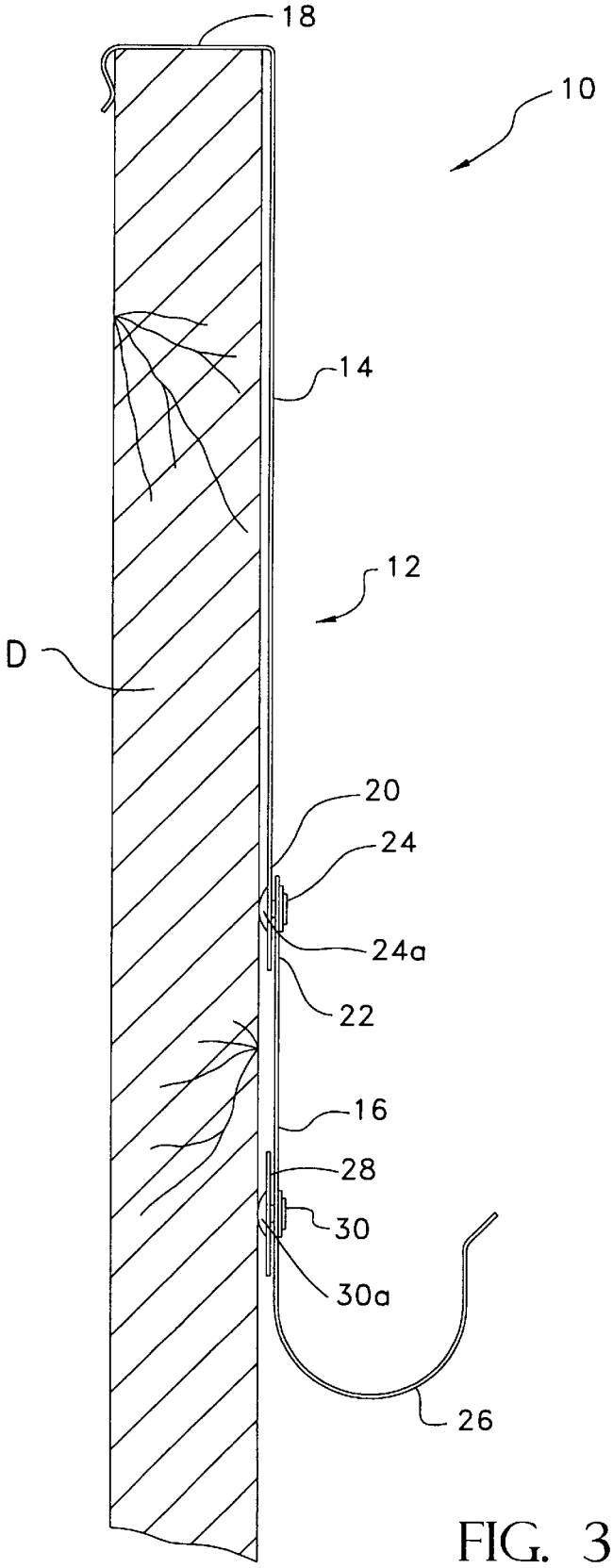
FIG. 3 is a side view of the ironing board holder shown hanging on a door.

The present invention is directed to an ironing board holder capable of holding an ironing board having T- and Y-shaped legs. With reference to the drawings, and particularly FIGS. 1, 2, and 3, an ironing board holder 10 is shown in FIG. 1 hanging over and supported on the top edge of a door D. The ironing board holder 10 is depicted in FIG. 1 supporting a conventional ironing board 100 by its T-shaped legs 102 so that the ironing board hangs therefrom.

As seen in FIG. 2, the ironing board holder 10 includes a pair of elongated support brackets 12. Each support bracket 12 includes an upper segment 14 and a lower segment 16. The support brackets 12 are shown as being fabricated from standard flat stock, but may be any other cross-sectional shape, such as tubular. It is contemplated that the support brackets are sufficiently dimensioned and fabricated from a suitable material to support the weight of a conventional ironing board. Typically, the support brackets are fabricated from metal, plastic, or the like and, according to one preferred embodiment, are approximately 11 inches long (28.57 cm), 1 inch wide (2.54 cm), and 0.050 inches thick (12.7 mm), if fabricated from metal.

Each upper mounting segment 14 has one end formed into an inverted rectangular J-shaped hook 18. The hook 18 has a sufficient clearance between its legs to removably, yet firmly, attach to the top edge of a door or similar planar support structure. For example, the J-hook 18 would be formed with a clearance of ⅓ inches (3.49 cm) to fit over a standard thickness door.

The opposite end 20 of the upper segment 14 is connected to and overlaps with an end 22 of the lower segment 16. The segment 14 is pivotally attached at end 20 to the segment 16 at the end 22 by a fastener, such as rivet 24. The pivotable connection 24 allows the segment 16 to pivot relative to the segment 14 for changing the orientation of the segment 16. The fastener 24 can be any suitable pivotable fastener such as a screw, nut and bolt, nail, or the like.

Each segment 16 has an opposite end formed into a U-shaped hook 26 for receiving and supporting the folded legs of an ironing board. The hooks 26 can be curved or angled to form the U-shape. The hook 26 has a sufficient diameter to receive an ironing board leg in a closely fitting manner. Typically, ironing board legs have a maximum diameter of 1¼ inches (3.17 cm). Of course any suitable receiving device can be substituted for hook 26, such as a notched segment, a flange, or the like.

Figure 6:
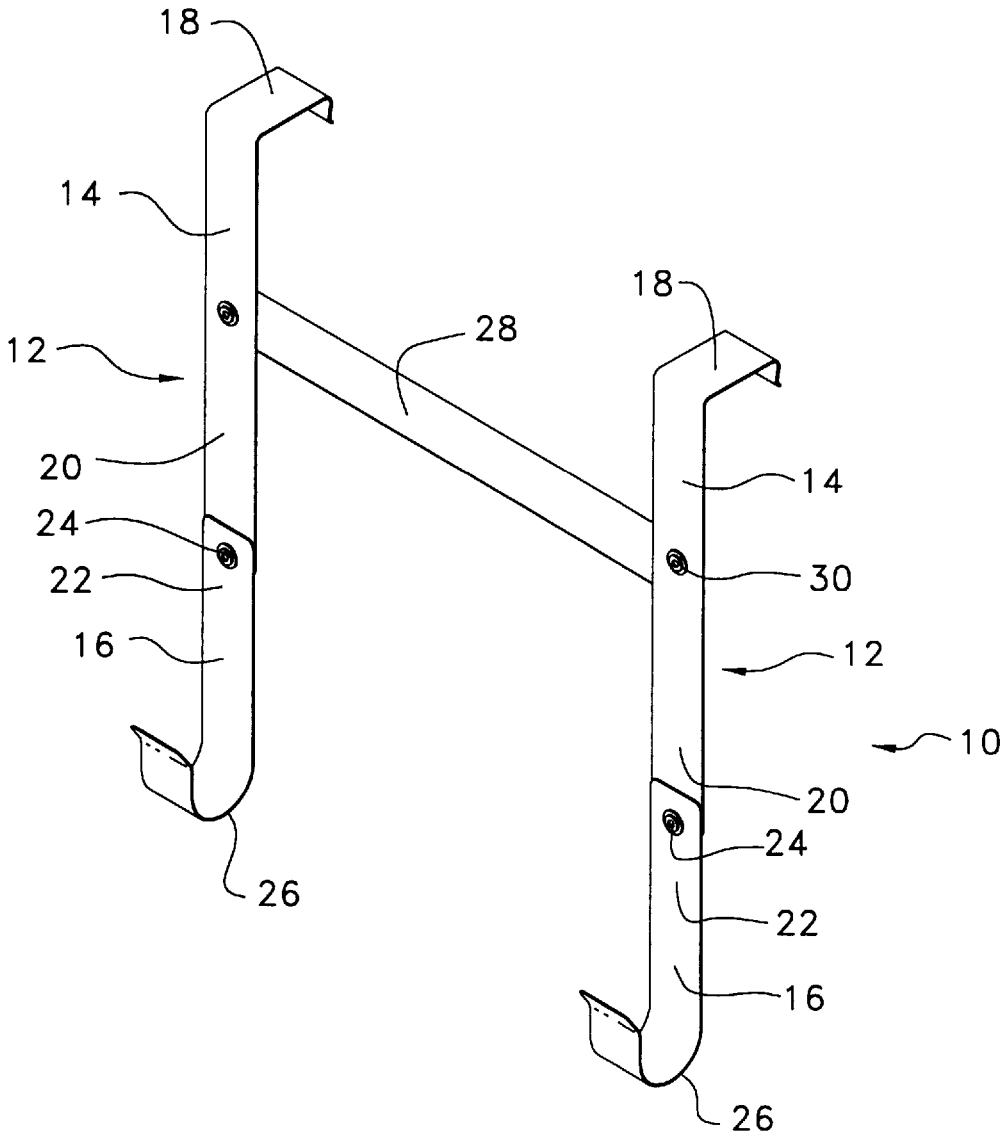
FIG. 6 is an oblique elevational perspective view of an alternate embodiment of the ironing board holder.

A crossbrace 28 connects the support brackets 12. The cross brace is pivotally attached on the back surface of the lower segment 16 between the pivotal connection 24 and the bight of the hook 26. Each end of the crossbrace 28 is pivotally attached to the segment 16 by a fastener, such as rivet 30. It is understood that the crossbrace 28 can be attached to the upper segments 14 as shown in FIG. 6. Typically, the crossbrace 28 is fabricated from the same material as the support brackets 12 and, according to one preferred embodiment, is approximately 10 inches long (25.4 cm), 1 inch wide (2.54 cm), and 0.050 inches thick (12.7 mm), if fabricated from metal. The fastener 30 is similar to the fastener 24.

In FIG. 3, the ironing board holder 10 is shown hanging on the door D. The J-hook 18 of each support bracket 12 is removably attached on the top edge of the door D. The segment 14 and the segment 16 are disposed adjacent to the face of the door D, typically the back side of a closet door. It is understood, however, that the ironing board holder can be attached to any suitable surface, such as a partition wall, a rod, or the like.

Each support bracket 12 is spaced from the face of the door D by enlarged rivet heads 24*a* and 30*a* of the rivets 24 or rivets 24 and 30, respectively, disposed on the back side of the support brackets. The rivet heads 24*a* and 30*a* engage the face of the door D distally from the top edge. The resulting friction and leverage provided by the rivet heads increase the lateral stability during swinging movement of the door. Thus, the door can be operated while the ironing board holder is secured thereon, supporting an ironing board, without significant risk that the assembly will slide laterally on the door, possibly scratching or marring the face of the door.

Figure 4:
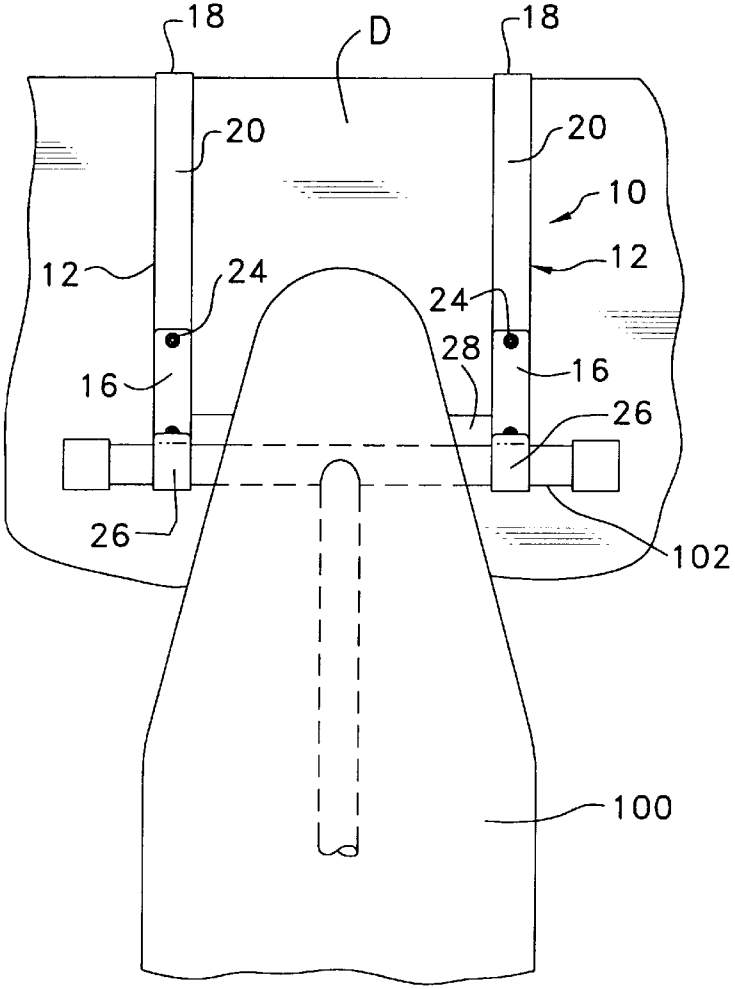
FIG. 4 is a front elevational view of the ironing board holder in a first position of use and shown holding an ironing board having a T-shaped leg.

In FIG. 4, the ironing board holder 10 is shown in an operational position suitable for holding an ironing board 100 having transversely extending T-shaped legs 102 (only one shown). The longitudinal axis of the segment 16 and the longitudinal axis of the segment 14 of each supporting bracket 12 are collinearly aligned. In this position the bottom portion of each hook 26 faces upwardly and provides a surface for removably receiving and supporting a transverse leg 102 of the ironing board 100. The longitudinal axis of the segments 16 are normal to the longitudinal axis of the leg 102 and approximately coaxial with the leg 102. In this way, the ironing board 100 can be hung from the support brackets 12 so that the longitudinal axis of the ironing board 100 is substantially parallel to the longitudinal axes of the support brackets 12, i.e. vertical.

Figure 5:
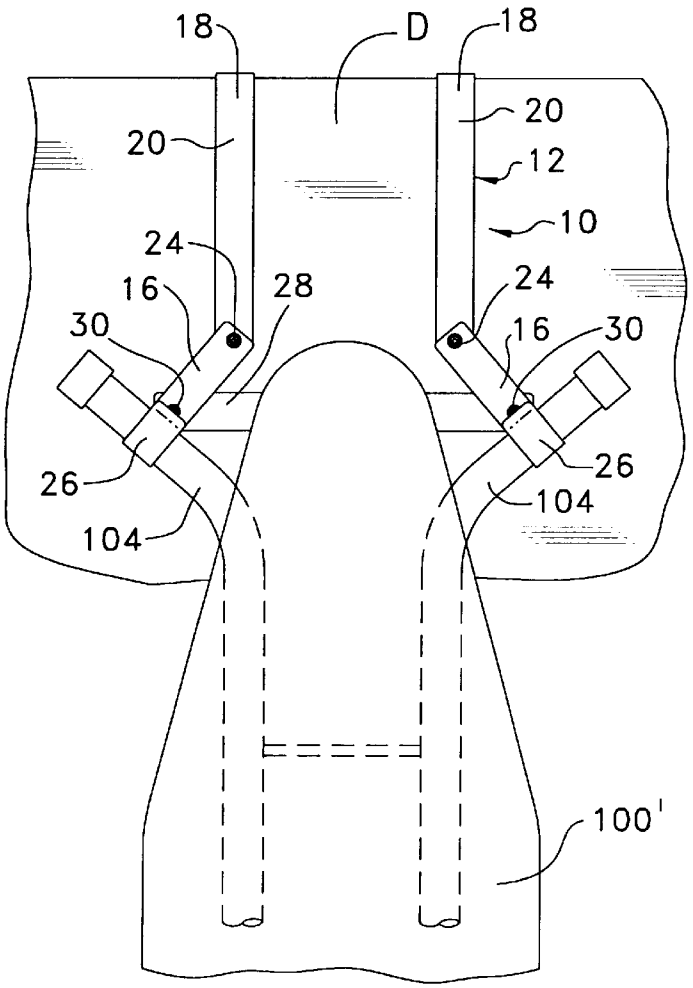
FIG. 5 is a front elevational view of the ironing board holder in a second position of use and shown holding an ironing board having Y-shaped legs.

In FIG. 5, the ironing board holder 10 is shown in another operational position suitable for holding an ironing board 100' having a pair of Y-shaped legs 104 (only one shown) which are angled with respect to the longitudinal axis of the ironing board 100'. To engage the inclined legs 104, each segment 16 is pivoted about fastener 30 until the longitudinal axis of the segment 16 is normal to the longitudinal axis of the inclined portion of a respective inclined leg 104. Each segment 14 is pivoted inwardly about fastener 24 until it is parallel to the longitudinal axis of the door D to facilitate proper engagement of the hooks 18 with the top edge of the door D. In this position each hook 26 is approximately coaxial with the inclined portion of one of the transverse legs 104. In this way, the ironing board 100' can be vertically hung from the support brackets 12 so that the longitudinal axis of the ironing board 100' is substantially parallel to the longitudinal axes of the segments 14, i.e., vertical.

Thus, the segments 16 can be pivoted to any angle of inclination necessary to receive the inclined or transverse legs of an ironing board or any other similar article having hook engageable surfaces.

The present invention may be embodied in other specific forms without departing from the spirit or essential attributes thereof and, accordingly, reference should be made to the appended claims, rather than to the foregoing specification, as indicating the scope of the invention.

What is claimed is:

1. A device for suspending an ironing board in an upright position comprising:

a plurality of support brackets, each support bracket comprising upper and lower segments pivotally connected to one another by a pivotal connection therebetween, each said support bracket having mounting means at one end for mounting the support bracket against an upright planar surface and holding means at the other end for holding a leg of the ironing board so as to suspend the ironing board in an upright storage position against the planar surface, and a crossbrace pivotally connecting the plurality of support brackets, the crossbrace being pivotally connected to the lower segments of the support brackets.

2. The device according to claim 1 wherein said mounting means comprises an inverted rectangular J-shaped hook.

3. The holder according to claim 2 wherein said holding means comprises an angled or a curved U-shaped hook.

4. The holder according to claim 1 wherein said holding means comprises an angled or a curved U-shaped hook.

5. The holder according to claim 1 wherein the support brackets are formed from plastic or metal.

6. The device according to claim 1 wherein the support brackets are pivotable between a first position in which the lower segment is aligned with the upper segment and a second position in which the lower segment is inclined outwardly relative to the upper segment.

7. A device for suspending an ironing board in an upright position comprising:

a plurality of support brackets, each support bracket comprising upper and lower segments pivotally connected to one another by a pivotal connection therebetween, each said support bracket having mounting means at one end for mounting the support bracket against an upright planar surface and holding means at the other end for holding a leg of the ironing board so as to suspend the ironing board in an upright storage position against the planar surface, and a crossbrace pivotally connecting the plurality of support brackets, the crossbrace being pivotally connected to the upper segments of the support brackets.

8. A device for suspending an ironing board in an upright position comprising:

a plurality of support brackets, each support bracket comprising upper and lower segments pivotally connected to one another by a pivotal connection therebetween, each said support bracket having a first hook at one end for mounting the support bracket against an upright planar surface and a second hook at the other end for holding a leg of the ironing board so as to suspend the ironing board in an upright storage position against the planar surface, and a crossbrace pivotally connecting the support brackets.

9. The device according to claim 8 wherein the ends of the crossbrace are connected to the upper segments of the support bracket.

10. The device according to claim 8 wherein the ends of the crossbrace are connected to the lower segments of the support bracket.

11. The device according to claim 8 wherein the support brackets are pivotable between a first position in which the lower segment is aligned with the upper segment and a second position in which the lower segment is inclined outwardly relative to the upper segment.

12. A device for suspending an ironing board in an upright position from a door having a top edge and a face comprising:

first and second support brackets, each support bracket comprising upper and lower segments pivotally connected to one another by a pivotal connection therebetween, each said support bracket having a first hook at one end for mounting the support bracket on the top edge of the door against the face of the door and a second hook at the other end for holding a leg of the ironing board so as to suspend the ironing board in an upright storage position against the face of the door, a crossbrace pivotally connecting the first and second support brackets.

13. The device according to claim 12 wherein the lower segment of the first support bracket is pivotally attached to one end of the crossbrace and the lower segment of the second support bracket is pivotally attached to an opposite end of the crossbrace.

14. The device according to claim 12 wherein the upper segment of the first support bracket is pivotally attached to one end of the crossbrace and the upper segment of the second support bracket is pivotally attached to an opposite end of the crossbrace.

15. The device according to claim 12 wherein said first hook has an inverted rectangular J-shape.

16. The device according to claim 12 wherein said second hook has an angled or a curved U-shape.

17. The device according to claim 12 wherein the support brackets are formed from plastic or metal.

18. The device according to claim 12 wherein the support brackets are pivotable between a first position in which the lower segment is aligned with the upper segment and a second position in which the lower segment is inclined outwardly relative to the upper segment.

* * * * *